United States Patent [19]

Niwata

[11] Patent Number: 4,977,717

[45] Date of Patent: Dec. 18, 1990

[54] APPARATUS FOR MOUNTING PANEL MEMBER

[75] Inventor: Sotoharu Niwata, Toyama, Japan

[73] Assignee: Yoshida Kogyo K. K., Tokyo, Japan

[21] Appl. No.: 457,354

[22] Filed: Dec. 27, 1989

[30] Foreign Application Priority Data

Dec. 28, 1988 [JP] Japan ..... 63-329379

[51] Int. Cl.[5] ..... E04H 1/00

[52] U.S. Cl. ..... 52/235; 52/403; 52/511; 52/398

[58] Field of Search ..... 52/235, 282, 375, 398, 52/403, 481, 508, 511, 512

[56] References Cited

U.S. PATENT DOCUMENTS

| | | | |
|---|---|---|---|
| 2,800,983 | 7/1957 | Toney | 52/282 X |
| 3,488,906 | 1/1970 | Brooks | 52/403 X |
| 3,509,612 | 5/1970 | Brooks | 52/235 |
| 3,553,918 | 1/1971 | Dauson | 52/235 X |
| 4,418,506 | 12/1983 | Weber et al. | 52/235 X |
| 4,543,755 | 10/1985 | Crandell | 52/511 X |
| 4,619,092 | 10/1986 | Kaminaga | 52/235 |
| 4,633,631 | 1/1987 | Crandell | 52/235 |
| 4,738,065 | 4/1988 | Crandell | 52/235 |
| 4,803,817 | 2/1989 | White et al. | 52/235 X |
| 4,903,454 | 2/1990 | Rose | 52/235 X |

FOREIGN PATENT DOCUMENTS

| | | | |
|---|---|---|---|
| 2608325 | 9/1977 | Fed. Rep. of Germany | 52/398 |
| 38-73411 | 5/1963 | Japan . | |

*Primary Examiner*—David A. Scherbel
*Assistant Examiner*—Creighton Smith
*Attorney, Agent, or Firm*—Hill, Van Santen, Steadman & Simpson

[57] ABSTRACT

In a curtain wall comprising a plurality of panel members (4) and panel columns (1), the panel members (4) are connected with the panel columns (1) through the supporting members (16) which are detachably mounted on the panel columns (1) to make it possible to position the panel members (4) along the panel columns (1) in a vertical direction by moving only the supporting members (16) along the panel columns (1) without moving the panel members (4) which are considerably heavy articles, so that the building worker can easily position the panel members (4) along the columns (1) in positioning operation of the panel members (4) without moving the considerably heavy panel members (4), which makes it possible to save considerable amounts of time and labor in mounting operation of the panel members (4) on the building side.

1 Claim, 5 Drawing Sheets

APPARATUS FOR MOUNTING PANEL MEMBER

BACKGROUND OF THE INVENTION

1. Field of the Invention

The present invention relates to an apparatus for mounting a panel member on an exterior side of a panel column of a curtain wall structure and the like employed in a building body.

2. Description of the Prior Art

Hitherto, with respect to apparatuses for mounting panel members on panel columns of the curtain wall structure employed in the building body, for example, Japanese Utility Model Laid-Open No. 63-73411 discloses one of the apparatuses for mounting the panel members.

In the conventional apparatus for mounting the panel member disclosed in the above Japanese Utility Model Laid-Open No. 63-73411: an adjusting member provided with an engaging-flange portion is mounted on an exterior side of a panel column in such a manner as to be movable in a vertical direction along the exterior side of the panel column; a frame member provided with a groove portion is fixedly mounted on each of a right and a left longitudinal edge of an interior side of the panel member; the engaging-flange portion of the adjusting member is inserted into the groove portion of the frame member; and the adjusting member is fixedly mounted on the exterior side of the panel column by fastening a screw.

In the conventional apparatus for mounting the panel member described above, it is very cumbersome to mount the adjusting member on the exterior side of the panel column because the adjusting member must be slidably moved from one of an upper and a lower end of the panel column to a predetermined position in which the adjusting member is temporarily fixed to the panel column by means of the screw.

In addition, in the above conventional apparatus, in order to mount the panel member on the panel column, it is necessary to insert the engaging-flange portion of the adjusting member into a notch portion of the groove portion of the frame member. However, it is very cumbersome to move the panel member, which is a considerably heavy article, in a vertical direction in order to position the panel member in a predetermined position in which the engaging-flange portion of the adjusting member is aligned with the notch portion of the groove portion of the frame member to enable the engaging-flange portion of the adjusting member to enter the groove portion of the frame member through the notch portion thereof.

SUMMARY OF THE INVENTION

It is an object of the present invention to provide an apparatus for mounting a panel member on an exterior side of a panel column, which apparatus may resolve the above problems inherent in the conventional apparatus for mounting the panel member.

The above object of the present invention is accomplished by providing:

An apparatus for mounting a panel member, comprising:

a panel column fixedly mounted on a building body so as to extend vertically, in an exterior-side portion of which column is formed a concave groove which is provided with a narrow and a wide opening portion and extends in a longitudinal direction of the panel column;

a frame member fixedly mounted on an interior-side vertical edge portion of the panel member, the frame member being provided with a groove portion which opens sideward and is provided with a notch portion which opens toward the interior of the building body;

a supporting member provided with a base portion one of opposite ends of which is formed into a mounting-flange portion slidably inserted into the wide opening portion of the concave groove of the panel column, the other of the opposite ends being formed into an engaging-flange portion which is slidably inserted into the groove portion of the frame member through the notch portion of the groove portion, the mounting-flange portion of the supporting member being received in the concave groove of the panel column in such a manner as to be movable between an interior-side position and an exterior-side position in the concave groove of the panel column and to be movable also in a vertical direction along the concave groove of the panel column;

a positioning block for positioning the supporting member in a vertical direction along the concave groove of the panel column, the positioning block being fixedly mounted in the concave groove of the panel column at a position under the wide opening portion of the concave groove of the panel column; and a screw for fixedly mounting the supporting member on the panel column in a condition in which the engaging-flange portion of the supporting member engages with the groove portion of the frame member.

As described above, in the apparatus of the present invention for mounting the panel member: the concave groove is formed in the exterior-side portion of the panel column; in the concave groove of the panel column is so received the supporting member as to be movable between the interior-side position and the exterior-side position in the concave groove of the panel column and to be movable also in a vertical direction along the concave groove of the panel column; the frame member provided with the groove portion having the notch portion is fixedly mounted on the interior-side vertical edge portion of the panel member; and the supporting member constituting a connecting means for connecting the panel member with the panel column is fixedly mounted on the panel column through the screw in a condition in which the engaging-flange portion of the supporting member engages with the groove portion of the frame member, so that it is possible for a building worker outside the building body to mount the supporting member on the panel column in such a manner as to permit the supporting member to move between the exterior-side position and the interior-side position thereof and to move also in a vertical direction along the panel column, whereby it is possible for the building worker outside of the building body to determine a mounting position of the panel member along the panel column by moving only the supporting member, which is a small and light article, without moving the panel member which is a considerably heavy article.

DESCRIPTION OF THE PREFERRED EMBODIMENTS

Hereinbelow, an embodiment of the present invention will be described in detail with reference to the accompanying drawings.

Figure 5:
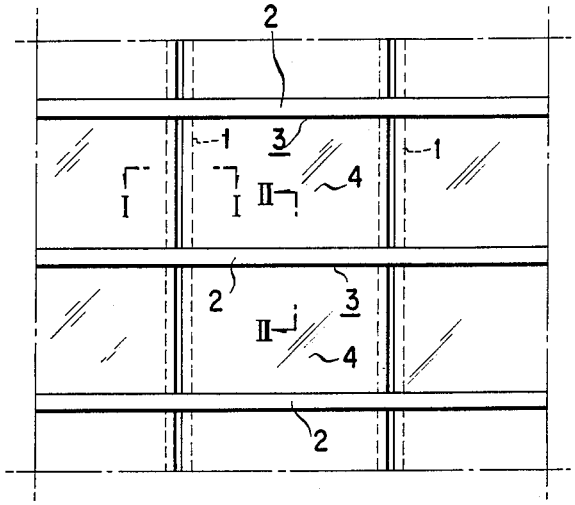
FIG. 5 is a front view of a curtain wall of a building body in which the apparatus of the present invention is employed.

As shown in FIG. 5, in a curtain wall of a building body in which an apparatus of the present invention for mounting a panel member is employed: a plurality of panel columns 1 are fixedly mounted on the building body so as to be vertically arranged while spaced apart from each other, between which panel columns 1 are horizontally interposed a plurality of lateral members 2 to form a plurality of frame portions 3 in each of which a panel member 4 is fixedly mounted.

Figure 3:
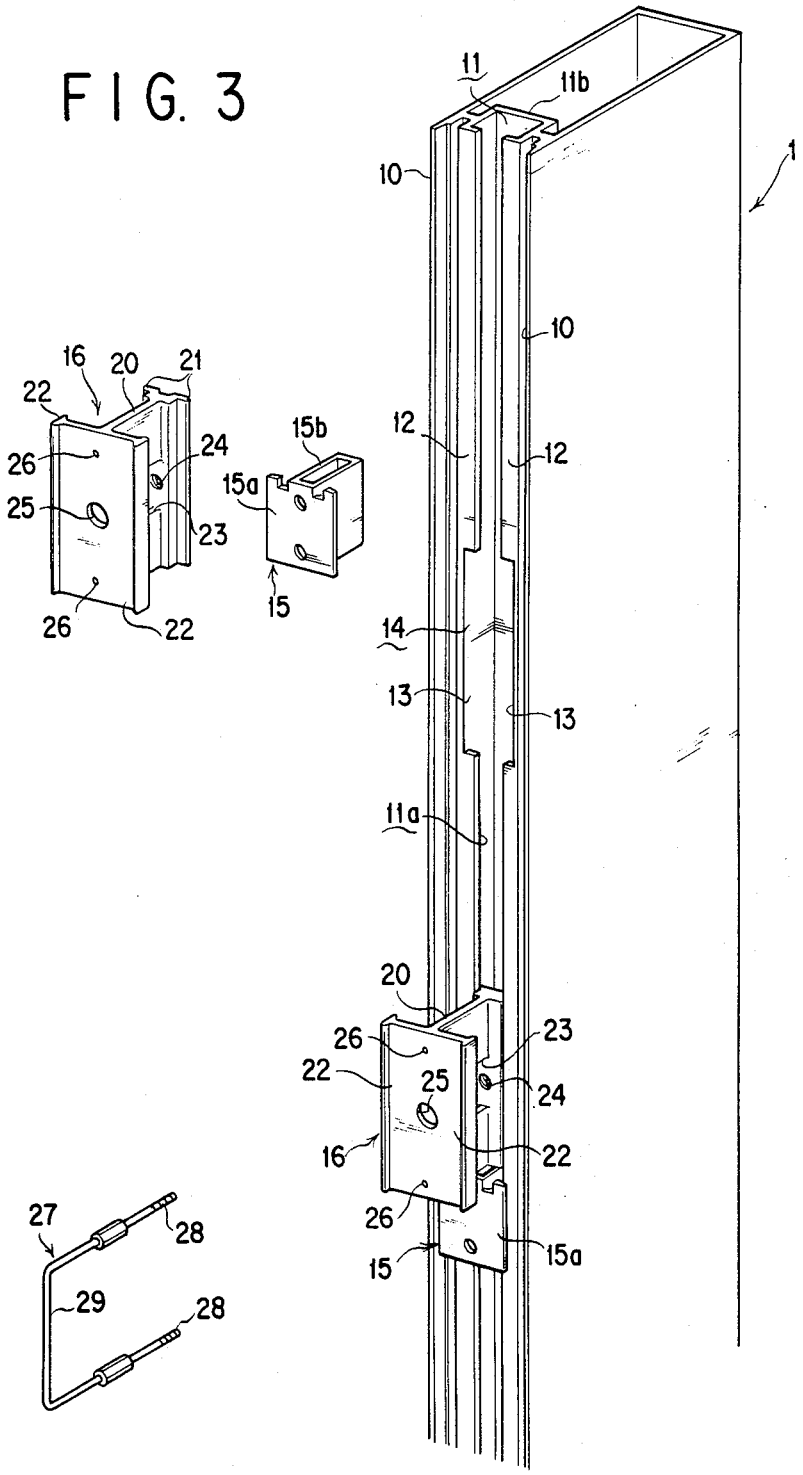
FIG. 3 is a perspective view of an essential part of the embodiment of the apparatus of the present invention shown in FIG. 5, illustrating the panel column, supporting member and the operating member of the apparatus of the present invention.

As shown in FIG. 3, the panel column 1 assumes a hollow elongated shape having a substantially rectangular configuration in its cross section, and is provided with: a right and a left supporting projection 10 oppositely disposed from each other in an exterior-side portion of the column 1; and a concave groove 11 in the exterior-side portion of the column 1, which groove 11 extends in a longitudinal direction of the column 1. The concave groove 11 of the column 1 is provided with a narrow opening portion 11*a* defined between a right and a left supporting-tab portion 12 of the column 1, which portions 12 are oppositely disposed from each other through the narrow opening portion 11*a*. A right and a left notch portion 13 are formed in the supporting-tab portions 12 of the column 1 so as to be oppositely disposed from each other to define a wide opening portion 14 under which a positioning block 15 for positioning a supporting member 16 along the panel column 1 is inserted into the concave groove 11 of the column 1 and fixedly mounted therein. On the other hand, the supporting member 16 is inserted into the concave groove 11 of the column 1 through the wide opening portion 14 and then moved downward along the concave groove 11 until it abuts on the positioning block 15. In a position in which the supporting member 16 abuts on the positioning block 15, the supporting member 16 is temporarily mounted on the column 1.

As shown in FIG. 3, the positioning block 15 is provided with a front-plate portion 15*a* and hollow projected portion 15*b* extending from a central part of the front-plate portion 15*a* in a direction perpendicular to the front-plate portion 15*a* so that the positioning block 15 assumes a substantially T-shaped form in plan view. The projected portion 15*b* of the positioning block 15 is inserted into the narrow opening portion 11*a* of the concave groove 11 of the panel column 1, and then bolted to a bottom portion 11*b* of the concave groove 11 by means of a screw a front-end portion of which passes through the positioning block 15 toward the interior side of the panel column 1.

As is clear from FIG. 3, the supporting member 16 is provided with a base portion 20 one of opposite ends of which is formed into a mounting-flange portion 21 extending in a direction perpendicular to the base portion 20. On the other hand, the other of the opposite ends of the base portion 20 of the supporting member 16 is formed into an engaging-flange portion 22 extending in a direction perpendicular to the base portion 20. Consequently, as is clear from FIG. 1, the supporting member 16 assumes a substantially H-shaped form in its plan view. A notched opening portion 23 is formed in an intermediate part of the base portion 20 of the supporting member 16. A tapped hole 24 is formed in the mounting-flange portion 21 of the supporting member 16. On the other hand, a through-hole 25 is formed in the engaging-flange portion 22 of the supporting member 16. Also provided in the engaging-flange portion 22 of the supporting member 16 are an upper and a lower tapped hole 26 which threadably engage with an upper and a lower threaded rod 28 of an operating member 27, respectively.

Incidentally, as shown in FIG. 3, the operating member 27 is provided with a substantially C-shaped main body 29 an upper and a lower bent portion of which are rotatably connected with the upper and the lower threaded rod 28, respectively.

Figure 2:
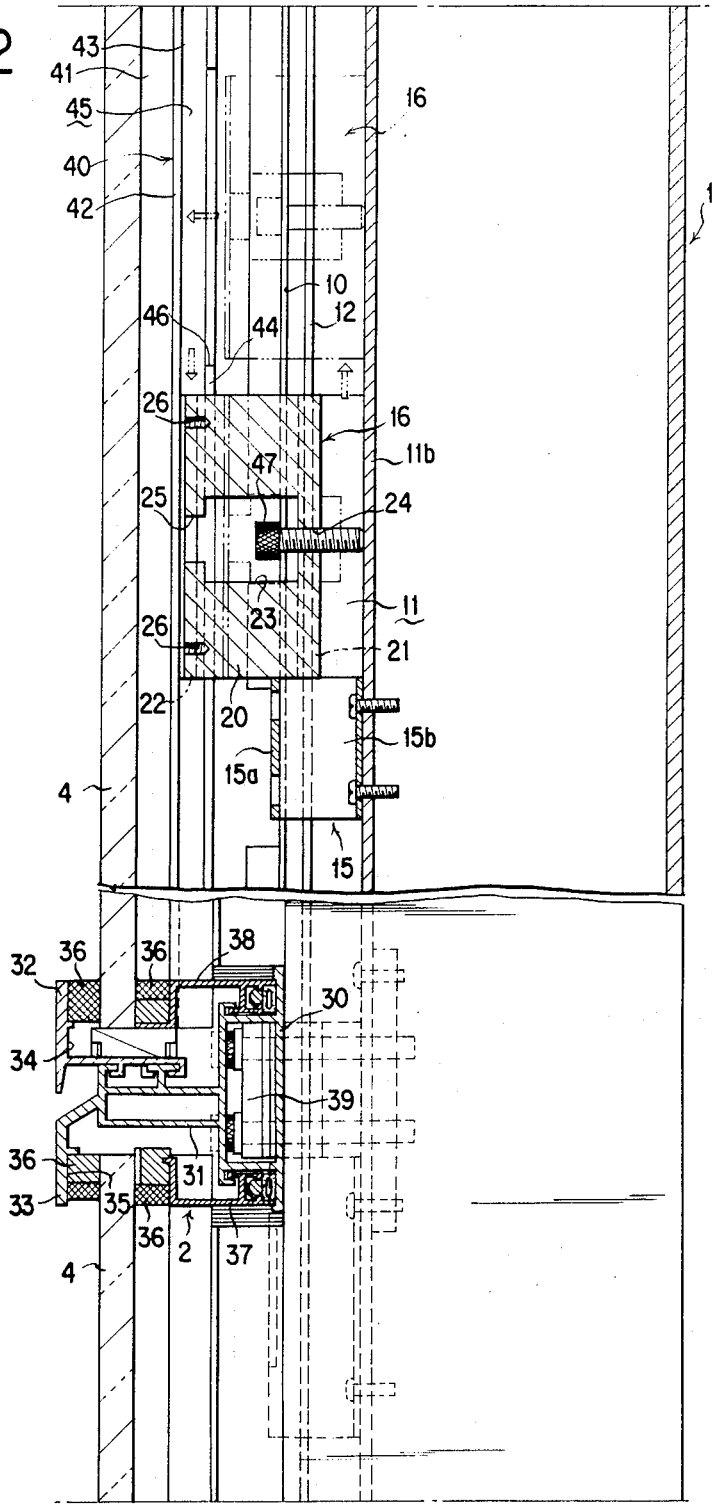
FIG. 2 is a sectional view of the embodiment of the apparatus of the present invention, taken along the line 11—11 of FIG. 5.

As shown in FIG. 2, the lateral member 2 is provided with: a hollow interior-side mounting portion 30; a hollow intermediate portion 31; an upper-tab portion 32 defining an upper-concave portion 34 which opens upward; and a lower-tab portion 33 defining a lower-concave portion 35 which opens downward. In the upper-concave portion 34 and the lower-concave portion 35 of the lateral member 2, a lower edge of a first panel member 4 and an upper edge of a second panel member 4 adjacent to the first panel member 4 are mounted through: a lower batten 38 and sealing members 36; and an upper batten 37 and sealing members 36, respectively. Incidentally, the lateral member 2 is pressed against the supporting projections 10 of the panel column 1 through a mounting member 39 so as to be fixedly mounted on the column 1.

Figure 4:
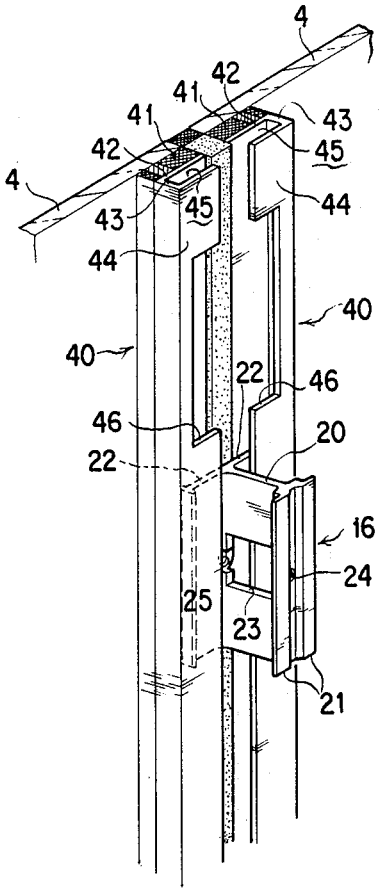
FIG. 4 is a perspective view of another esential part of the embodiment of the apparatus of the present invention shown in FIG. 5, illustrating the interior-side surface of the panel member, supporting member and frame members of the apparatus of the present invention.

As shown in FIG. 4, an elongated frame member 40 is adhesively mounted on each of a right and a left longitudinal edge of an interior side of the panel member 4 through a structural seal 41. The frame member 40 is provided with a mounting-plate portion 42, an end-plate portion 43 and a supporting-plate portion 44 to assume a substantially C-shaped form provided with a groove portion 45 which opens sideward in plan view. More particularly, the mounting-plate portion 42 of the frame member 40 is adhesively mounted on the interior-side surface of the panel member 4 through the structural seal 41. In the supporting-plate portion 44 of the frame member 4 is formed a notch portion 46 through which the engaging-flange portion 22 of the supporting member 16 is inserted into the groove portion 45 of the frame member 40.

Figure 1:
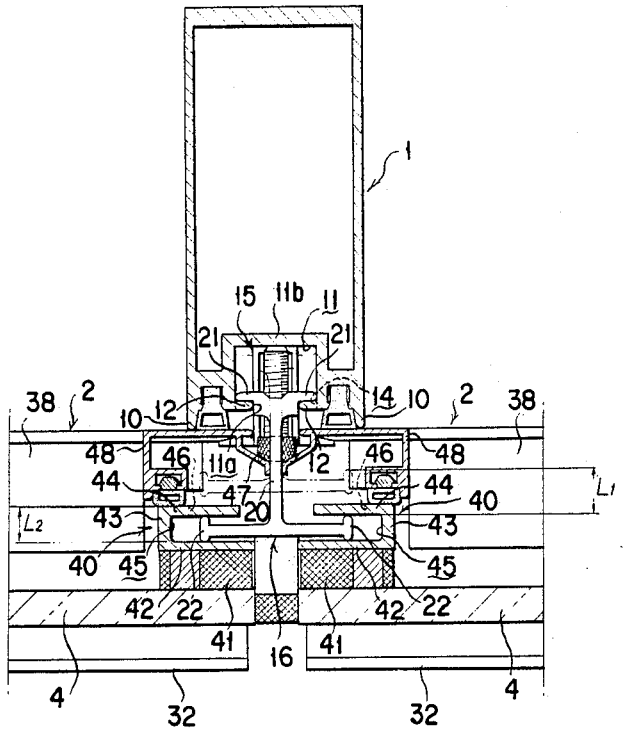
FIG. 1 is a sectional view of an embodiment of the apparatus of the present invention for mounting the panel member on the panel column, taken along the line 1—1 of FIG. 5.

On the other hand, in mounting operation of the panel member 4, the mounting-flange portion 21 of the supporting member 16 is slidably received in the concave groove 11 of the panel column 1 so as to be movable between: an exterior-side position shown by solid lines in FIG. 1; and an interior-side position shown by dashed lines in FIG. 1, and as to be movable along the concave groove 11 of the panel column 1 in a vertical direction. A moving range or stroke $L_1$ of the supporting member 16 between the exterior-side position and the interior-side position in the concave groove 11 of the panel column 1 is slightly larger than the sum $L_2$ of a width of the groove portion 45 of the frame member 40 and a thickness of the supporting-plate portion 44 of the frame member 40. Consequently, when the supporting member 16 is positioned in the interior-side position, the engaging-flange portion 22 of the supporting member 16 is separated from the frame member 40. On the other hand, when the supporting member 16 is positioned in the exterior-side position, the engaging-flange portion 22 of the supporting member 16 is received in the groove portion 45 of the frame member 40. Namely, in the mounting operation of the panel member 4, first of all, the supporting member 16 is moved into the exterior-side position to enable the engaging-flange portion 22 thereof to enter the groove portion 45 of the frame member 40 through the notch portion 46 of the frame member 40. Then, the engaging-flange portion 22 of the supporting member 16 is vertically moved downward in the groove portion 45 of the frame member 40 to permit the engaging-flange portion 22 of the supporting member 16 to engage with the groove portion 45 of the frame member 40. After that, the supporting member 16 is bolted to the panel column 1 by means of a screw 47 to enable the panel member 4 to be mounted on the column 1 as shown in FIG. 1.

Now, operation for mounting the panel member 4 on the exterior side of the panel column 1 will be described stepwise in detail:

In a first step: the lateral members 2 are horizontally interposed between the exterior-side portions of the panel columns 1 adjacent to each other; and, as shown in FIGS. 2 and 3, the positioning block 15 is inserted into the concave groove 11 of the column 1 and bolted thereto;

In a second step: the mounting-flange portion 21 of the supporting member 16 is inserted into the concave groove 11 of the panel column 1 through the wide opening portion 14 of the column 1, and then moved downward along the concave groove 11 to abut on the positioning block 15. As a result, since the supporting-tab projections 12 of the column 1 interfere with the mounting-flange portion 21 of the supporting member 16 to prevent the supporting member 16 from dropping out of the concave groove 11 of the column 1, the supporting member 16 is positioned and temporarily mounted in the concave groove 11 of the column 1;

In a third step: in a condition in which the frame member 40 is fixedly mounted on each of the right and the left longitudinal edge of the interior side of the panel member 4 so as to be oppositely disposed from each other, the panel member 4 is interposed between a lateral member 2 and a second lateral member 2 adjacent to the first lateral member 2 in such a manner as to permit the upper and a lower edge portions of the panel member 4 to be detachably mounted in the lower concave portion 35 of the first lateral member 2 and the upper concave portion 34 of the second lateral members 2, respectively. In this third step, the supporting member 16 is positioned in the interior-side position in the concave groove 11 of the column 1 so as to prevent the engaging-flange portion 22 of the supporting member 16 from interfering with the frame members 40;

In a fourth step: through a clearance defined between the panel members 4, the upper and the lower threaded rods 28 of the operating member 27 are threadably engaged with the tapped holes 26 formed in the engaging-flange portion 22 of the supporting member 16 so that the operating member 27 is fixedly mounted on the supporting member 16. Under such circumstances, the building worker outside the building body holds the main body 29 of the operating member 27 in his hand and moves the supporting member 16 to an upper position thereof shown by dashed lines in FIG. 2, in which upper position the engaging-flange portion 22 of the supporting member 16 is aligned with the notch portion 46 of the frame member 40 to permit the supporting member 16 to be moved to the exterior-side position thereof, so that the engaging-flange portion 22 of the supporting member 16 enters the groove portions 45 of the frame members 40 through the notch portions 46 of the frame members 40. After the engaging-flange portion 22 of the supporting member 16 is received in the groove portions 45 of the frame members 40, the supporting member 16 is moved downward along the groove portion 45 of the frame members 40 so as to abut on the positioning block 15, whereby the engaging-flange portion 22 of the supporting member 16 is prevented from dropping out of the groove portion 45 of the frame members 40 by means of the supporting-plate portions 44 of the frame member 16;

In a fifth step: after the supporting member 16 is positioned along the concave groove 11 of the panel column 1 as described above, the operating member 27 is removed from the supporting member 16. Then, the screw 47 passes through the through-hole 25 of the supporting member 16, and is threadably engaged with the tapped hole 24 of the supporting member 16 to abut on the bottom portion 11*b* of the concave groove 11 of the panel column 1 so that the mounting-flange portion 21 of the supporting member 16 is pressed against inner surfaces of the supporting-tab portions 12 of the panel column 1, whereby the supporting member 16 is fixedly mounted on the column 1. In fastening operation of the screw 47, the screw 47, which is accessible through the notched opening portion 23 of the base portion 20 of the supporting member 16, is fastened by a suitable driver. Incidentally, the screw 47 may threadably engage with the tapped hole 24 of the supporting member 16 before the supporting member 16 is mounted on the panel column 1; and In a sixth step: the upper batten 37, lower batten 38 and a right and a left batten 48 are mounted on the upper edge portion, lower edge portion and a right and a left vertical edge portion of the panel member 4, respectively. After that, the sealing members 36 are mounted on these edges of the panel member 4. Incidentally, the above battens 37, 38, 48 may be mounted on the above edges of the panel member 4 before the panel member 4 is mounted on the column 1.

In the apparatus of the present invention for mounting the panel member 4 on the exterior side of the panel column 1 having the above construction, as described above, since the mounting-flange portion 21 of the supporting member 16 is inserted into the concave groove 11 of the column 1 through the wide opening portion 14 of the concave groove 11 and then moved downward along the concave groove 11 to abut on the positioning block 15, it is possible for the building worker to easily position the supporting member 16 along the concave groove 11 of the column 1 in a vertical direction. After the mounting-flange portion 21 of the supporting member 16 abuts on the positioning block 15, the mounting-flange portion 21 of the supporting member 16 interferes with the supporting projections 10 of the column 1 to make it possible to temporarily mount the supporting member 16 on the column 1.

Consequently, in the apparatus of the present invention, the building worker outside the building body can position and temporarily mount the supporting member 16 on the column 1 easily. As a result, the supporting member 16 of the apparatus of the present invention is fixedly mounted on the column 1 easily.

In the apparatus of the present invention, since the supporting member 16 is mounted on the panel column 1 in such a manner as to be movable between the exterior-side position and the interior-side position thereof in the concave groove 11 of the column 1 and as to be movable also along the concave groove 11 of the column 1 in a vertical direction, the supporting member 16 disposed outside the building body can be easily fixedly mounted on the column 1 by: lifting the supporting member 16 disposed outside the building body so as to align its engaging-flange portion 22 with the notch portion 14 of the concave groove 11 of the column 1 so that the supporting member 16 is permitted to move to its interior-side position, whereby the engaging-flange portion 22 of the supporting member 16 enters the groove portion 45 of the frame members 40 through the notch portions 46 of the supporting-plate portions 44 of the frame members 40 to enable the supporting member 16 to move downward along the concave groove 11 of the column 1 to abut on the positioning block 15, the supporting member 16 having been abutted on the positioning block 15 being fixedly mounted on the column 1 by fastening the screw 47.

As is clear from the above description, in positioning operation of the panel member 4, it is possible for the apparatus of the present invention to position the panel member 4, which is a considerably heavy article, along the column 1 in a vertical direction by moving only the supporting member 16: in a horizontal direction between the exterior-side position and the interior-side position thereof in the concave groove 11 of the column 1; and in a vertical direction along the concave groove 11, without moving the panel member 4 itself. Consequently, it is possible for the building worker to easily position the panel member 4 along the column 1 by employing the apparatus of the present invention, which enables the building worker to easily mount the panel member 4 on the column 1 and to save a considerable amount of time and labor.

Since many changes and modifications can be made to the above construction of the apparatus of the present invention without departing from the spirit of the present invention, it is intended that all matters given in the above description and illustrated in the accompanying drawings shall be interpreted to be illustrative only and not as a limitation to the scope of the present invention.

What is claimed is:

1. An apparatus for mounting a panel member (4), comprising:

a panel column (1) fixedly mounted on a building body so as to extend vertically, in an exterior-side portion of which panel column (1) is formed a concave groove (11) provided with a narrow opening portion **(11*a*) and a wide opening portion (14), said concave groove (11) extending a longitudinal direction of said panel column (1)**;

a frame member (40) fixedly mounted on an interior-side vertical edge portion of said panel member (4), said frame member (4) being provided with a groove portion (45) which opens sideward and is provided with a notch portion (46) opening into the interior of said building body;

a supporting member (16) provided with a base portion (20) one of opposite ends of which is formed into a mounting-flange portion (21) slidably inserted into said wide opening portion (14) of said concave groove (11) of said panel column (1), the other of said opposite ends being formed into an engaging-flange portion (22) which is slidably inserted into said groove portion (45) of said frame member (4) through said notch portion (46) of said groove portion (45), said mounting-flange portion (21) of said supporting member (16) being received in said concave groove (11) of said panel column (1) in such a manner as to be movable between an interior-side position and an exterior-side position and also to be movable in a vertical direction;

a positioning block (15) for positioning said supporting member (16) in a vertical direction along said concave groove (11) of said panel column (1), said positioning block (15) being fixedly mounted in said concave groove (11) of said panel column (1) at a position under said wide opening portion (14) of said concave groove (11) of said panel column (1); and a screw (47) for fixedly mounting said supporting member (16) on said panel column (1) in a condition in which said engaging-flange portion (22) of said supporting member (16) engages with said groove portion (45) of said frame member (40).

* * * * *